US007056635B2

(12) United States Patent
Tanaka et al.

(10) Patent No.: US 7,056,635 B2
(45) Date of Patent: Jun. 6, 2006

(54) TONER, METHOD OF PRODUCING THE TONER, DEVELOPER INCLUDING THE TONER, AND IMAGE FORMING METHOD AND APPARATUS USING THE DEVELOPER

(75) Inventors: Chiaki Tanaka, Shizuoka-ken (JP); Naohiro Watanabe, Shizuoka-ken (JP); Takeshi Takada, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 180 days.

(21) Appl. No.: 10/706,113

(22) Filed: Nov. 13, 2003

(65) Prior Publication Data

US 2004/0142264 A1 Jul. 22, 2004

(30) Foreign Application Priority Data

Nov. 14, 2002 (JP) ..... 2002-331217

(51) Int. Cl.
*G03G 9/087* (2006.01)

(52) U.S. Cl. ..... 430/108.4; 430/108.8; 430/110.1; 430/111.4; 430/137.1; 430/137.18; 430/124; 399/111

(58) Field of Classification Search ..... 430/108.4, 430/108.8, 110.1, 111.4, 137.1, 137.15, 137.18, 430/124; 399/111
See application file for complete search history.

(56) References Cited

U.S. PATENT DOCUMENTS 5,935,751 A * 8/1999 Matsuoka et al. ..... 430/108.8
5,976,746 A 11/1999 Tanaka et al.
6,066,428 A 5/2000 Katayama et al.
6,172,176 B1 1/2001 Tanaka et al.
6,187,494 B1 2/2001 Kawamura et al.
6,194,535 B1 2/2001 Katayama et al.
6,303,736 B1 10/2001 Kawamura et al.
6,313,288 B1 11/2001 Shimada et al.
6,395,442 B1 * 5/2002 Hayashi et al. ..... 430/109.4
6,465,648 B1 10/2002 Tadokoro et al.
6,492,079 B1 12/2002 Shimada et al.
6,503,676 B1 1/2003 Yamashita et al.
6,524,761 B1 2/2003 Shimada et al.
6,544,701 B1 4/2003 Tadokoro et al.
6,548,216 B1 4/2003 Kawamura et al.
6,593,048 B1 7/2003 Sasaki et al.
6,596,449 B1 7/2003 Shimada et al.
6,653,037 B1 11/2003 Sawada et al.
6,660,443 B1 12/2003 Sugiyama et al.
6,667,141 B1 12/2003 Iwamoto et al.
6,821,698 B1 * 11/2004 Sawada et al. ..... 430/108.4

FOREIGN PATENT DOCUMENTS

JP 60-090344 5/1985
JP 62-063940 3/1987
JP 64-015755 1/1989
JP 02-082267 3/1990
JP 03-041470 2/1991
JP 03-229264 10/1991
JP 11-249339 9/1999
JP 11-305486 11/1999
JP 2001-222138 8/2001

* cited by examiner

*Primary Examiner*—John L Goodrow
(74) *Attorney, Agent, or Firm*—Oblon, Spivak, McClelland, Maier & Neustadt, P.C.

(57) ABSTRACT

A toner including a thermoplastic resin; a colorant; a wax; and a crystalline polymer, wherein a DSC endothermic peak temperature of the wax or the crystalline polymer determined by subjecting the toner to a differential scanning calorimetric analysis is lower by not less than 2° C. than a DSC endothermic peak temperature thereof determined when only the wax or the crystalline polymer is subjected to the differential calorimetric analysis.

36 Claims, 4 Drawing Sheets

TONER, METHOD OF PRODUCING THE TONER, DEVELOPER INCLUDING THE TONER, AND IMAGE FORMING METHOD AND APPARATUS USING THE DEVELOPER

BACKGROUND OF THE INVENTION

1. Field of the Invention

The present invention relates to a toner, and more particularly to a toner having improved low-temperature fixability, high temperature preservability and offset resistance. The invention further relates to a process cartridge that includes a photoreceptor, and at least one of a charger, a cleaner and an image developer, that may use the toner, and an image forming apparatus including the process cartridge.

2. Discussion of the Background

Recently, in order to save energy for fixing a toner in image forming methods such as for example photocopying, the fixing energy is required to be small. Therefore, it is necessary to control the thermal properties of the toner itself, i.e., a resin. However, a resin having a low glass transition temperature (Tg) gives a toner wherein high temperature preservability and fixability have been deteriorated, and a low-molecular-weight resin having a low $F_{1/2}$ temperature has problems of occurrence of hot offset and too high glossiness. Thus, a toner having good low-temperature fixability, high temperature preservability and offset resistance has not yet been obtained by controlling the thermal properties of the resin itself.

In order to obtain the desirable low-temperature fixability, Japanese Laid-Open Patent Publications Nos. 60-90344, 64-15755, 2-82267, 3-229264, 3-41470 and 11-305486 disclose the use of a polyester resin having good low-temperature fixability and comparatively good high temperature preservability in comparison to the styrene-acrylic resins conventionally and frequently used. Japanese Laid-Open Patent Publication No. 62-63940 discloses the inclusion of a specific non-olefin crystalline polymer having a sharp melting capability at its glass transition temperature in a binder for the purpose of improving low-temperature fixability of the resultant toner. However, it cannot be said that its molecular geometry and weight are optimized.

Japanese Patent No. 2931899 and Japanese Laid-Open Patent Publication No. 2001-222138 disclose the use of a crystalline polyester having a same sharp melting capability. However, the crystalline polyester in Japanese Patent No. 2931899 has a low acid value (not greater than 5) and a low hydroxyl value (not greater than 20), and has a low affinity with a paper. Therefore, the resultant toner does not have sufficient low-temperature fixability. In addition, its molecular geometry and weight are optimized. Further, the resultant toner does not have good transferability, durability, charge stability against humidity and pulverizability or sufficient low-temperature fixability and offset resistance even in a fixing method carried out without coating a release oil or with a very slight application thereof on a fixing roller while having adequate glossiness. In Japanese Laid-Open Patent Publication No. 2001-222138, the resultant toner does not have good transferability, durability, charge stability against humidity and pulverizability or sufficient low-temperature fixability and offset resistance even in a fixing method carried out without coating a release oil or with a very slight application thereof on a fixing roller while having adequate glossiness.

Because of these reasons, a need exists for a toner having improved dispersibility and pulverizability as well as improved low-temperature fixability, high temperature preservability and offset resistance.

SUMMARY OF THE INVENTION

Accordingly, an object of the present invention is to provide a toner having improved dispersibility and pulverizability as well as improved low-temperature fixability, high temperature preservability and offset resistance, and a method of producing the toner.

Another object of the present invention is to provide a developer including the toner, a container including the developer, an image forming method and an image forming apparatus using the developer.

A further object of this invention is to provide a cartridge which may use the toner and the developer where the cartridge includes a photoreceptor, and at least one of a charger, a cleaner and an image developer.

Another object of the present invention is to provide an image forming apparatus that may include the process cartridge and toner of the invention.

These objects and other objects of the present invention as hereinafter described will become more readily apparent. The toner of the invention can be attained by a toner including a thermoplastic resin; a colorant; a wax; and a crystalline polymer therein, wherein a DSC endothermic peak temperature of the wax or the crystalline polymer determined by subjecting the toner to a differential scanning calorimetric analysis is lower by not less than 2° C. than a DSC endothermic peak temperature thereof determined when only the wax or the crystalline polymer is subjected to the differential calorimetric analysis.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the invention becomes better understood from the detailed description when considered in connection with the accompanying drawings in which like reference characters designate like corresponding parts throughout and wherein.

DETAILED DESCRIPTION OF THE INVENTION

Figure 1:
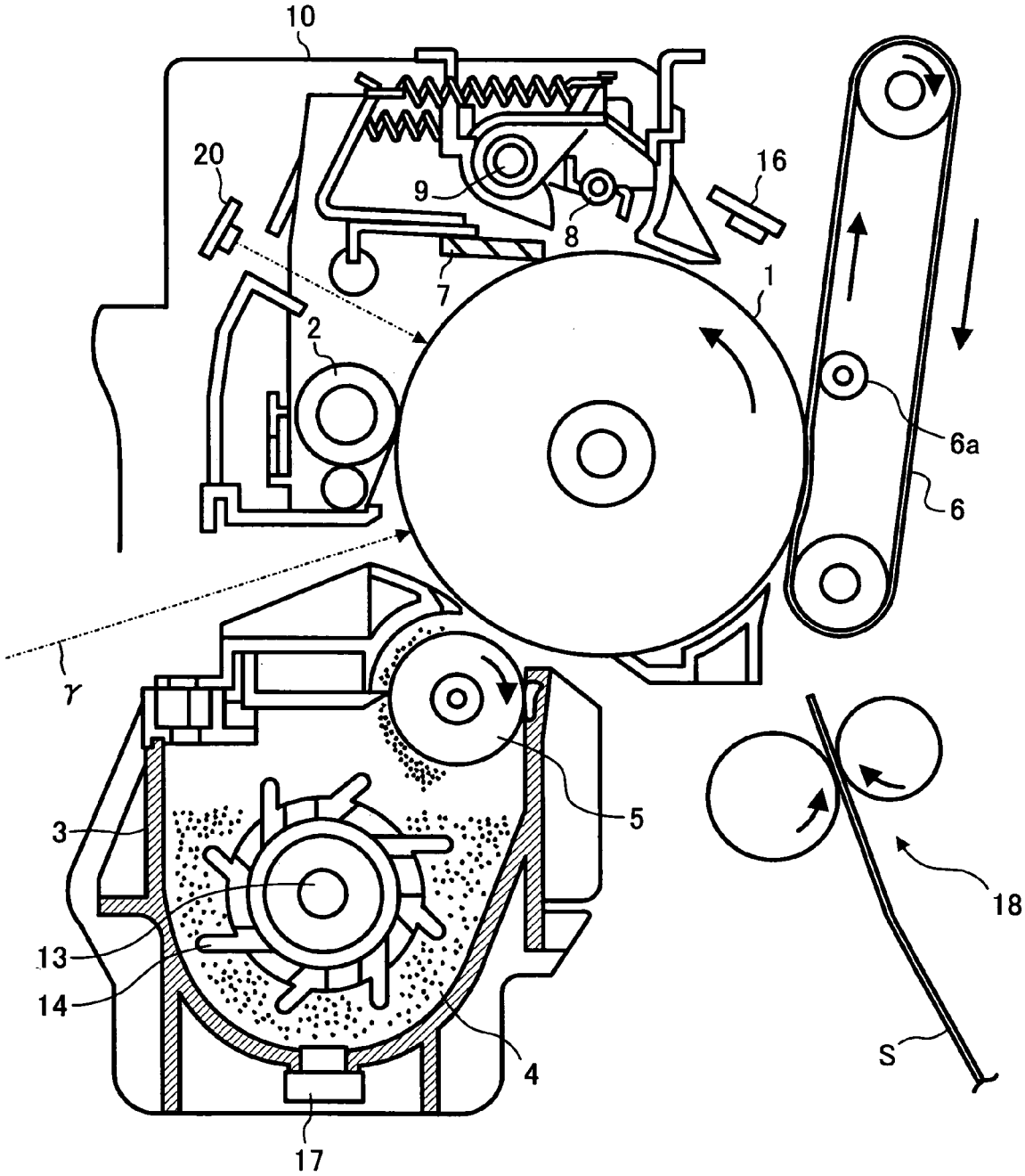
FIG. 1 is a schematic view illustrating an embodiment of the image forming apparatus of the present invention.

Generally, the present invention provides a toner having good low-temperature fixability, high temperature preservability, offset resistance, dispersibility and pulverizability. In one embodiment the toner includes at least a thermoplastic resin; a colorant; a wax; and a crystalline polymer, wherein at least one of the DSC endothermic peak temperatures of the wax and crystalline polymer obtained by measuring the toner by a differential scanning calorimeter is lower by not less than 2° C. than DSC endothermic peak temperatures of the wax or the crystalline polymer when the wax or crystalline polymer are independently measured thereby.

The DSC property mentioned above is thought to arise when the thermoplastic resin, wax and crystalline polymer are partially soluble with each other, and the soluble part works as a starting point of melting in fixation and efficiently melts the whole toner to realize unprecedented low-temperature fixability and thereby provide a toner having a sharp melting capability. When one of the DSC endothermic peak temperatures of the wax and crystalline polymer determined when the toner is measured by differential scanning calorimetry is lower by less than 2° C. than the corresponding DSC endothermic peak temperatures when the wax and crystalline polymer are independently measured, the toner does not have notable low-temperature fixability. When the thermoplastic resin, wax and crystalline polymer are dissolved with each other and form a DSC endothermic peak, high temperature preservability of the toner deteriorates.

In one embodiment of the invention the toner includes a thermoplastic resin; a colorant; a wax; and a crystalline polymer, and at least one of the following relationships is satisfied:

$$Tg(W_T)<Tg(W_W)-2$$

$$Tg(CP_T)<Tg(CP_{CP})-2$$

where Tg ($W_T$) is the DSC endothermic peak temperature in ° C. of the wax measured in the toner, Tg($W_W$) is the DSC endothermic peak temperature in ° C. of the wax measured alone, Tg($CP_T$) is the DSC endothermic peak temperature in ° C. of the crystalline polymer measured in the toner, and Tg($CP_{CP}$) is the DSC endothermic peak temperature in ° C. of the crystalline polymer measured alone.

The crystalline polymer is considered to contribute to the high temperature preservability. The crystalline polymer rapidly lowers its melting viscosity from a solid state at a temperature not less than its melting point and has good fixability on a paper. In addition, the crystalline polymer is a crystal at a temperature less than its melting point and its hardness contributes to the high temperature preservability of the toner. Further, a toner including a thermoplastic resin, a wax and a crystalline polymer, wherein the wax and the crystalline polymer are partially soluble with each other, has good dispersibility and pulverizability.

The crystalline polymer preferably has a DSC endothermic peak temperature of from 80 to 150° C. to provide a toner having both low-temperature fixability and high temperature preservability.

Specific examples of the crystalline polymer include a polyethylene resin, a polybutadiene resin, a polyester resin, etc. Among these resins, the polyester resin is preferably used in terms of its crystallinity and softening point. Particularly, a crystalline polyester formed from an alcohol including diol compounds having 2 to 6 carbon atoms such as 1,4-butandiol and 1,6-hexanediol and their derivatives and an acid such as maleic acid, fumaric acid and succinic acid and their derivatives and having the following formula (1) is preferably used:

$$[—O—CO—CR_1=CR_2—CO—O—(CH_2)_n—]_m \quad (1)$$

wherein $R_1$ and $R_2$ independently represent a hydrocarbon group, and n and m are repeat numbers.

Methods of controlling the crystallinity and softening point of the crystalline polyester include a method of designing and using non-linear polyester formed by a condensation polymerization in which a polyalcohol having 3 or more valences such as glycerin is added to the alcohol or polycarboxylic acid having 3 or more valences such as trimellitic anhydride is added to the acid when the polyester is formed.

The molecular geometry of the crystalline polymer material can be identified by solid state NMR, etc. The crystalline polymer preferably has a peak of from 3.5 to 4.0 and a half width of not greater than 1.5 in a molecular weight distribution by a GPC of its components soluble with o-dichlorobenzene, wherein the x-axis represents log (M) and the y-axis represents % by weight. In addition, the crystalline polymer preferably has a weight-average molecular weight (Mw) of from 1,000 to 6,500, a number-average molecular weight (Mn) of from 500 to 2,000 and a ratio Mw/Mn of from 2 to 5. Further, the crystalline polymer preferably has a sufficiently low melting point and a $F_{1/2}$ temperature of from 90 to 130° C. such that high temperature preservability of the resultant toner does not deteriorate.

Figure 2:
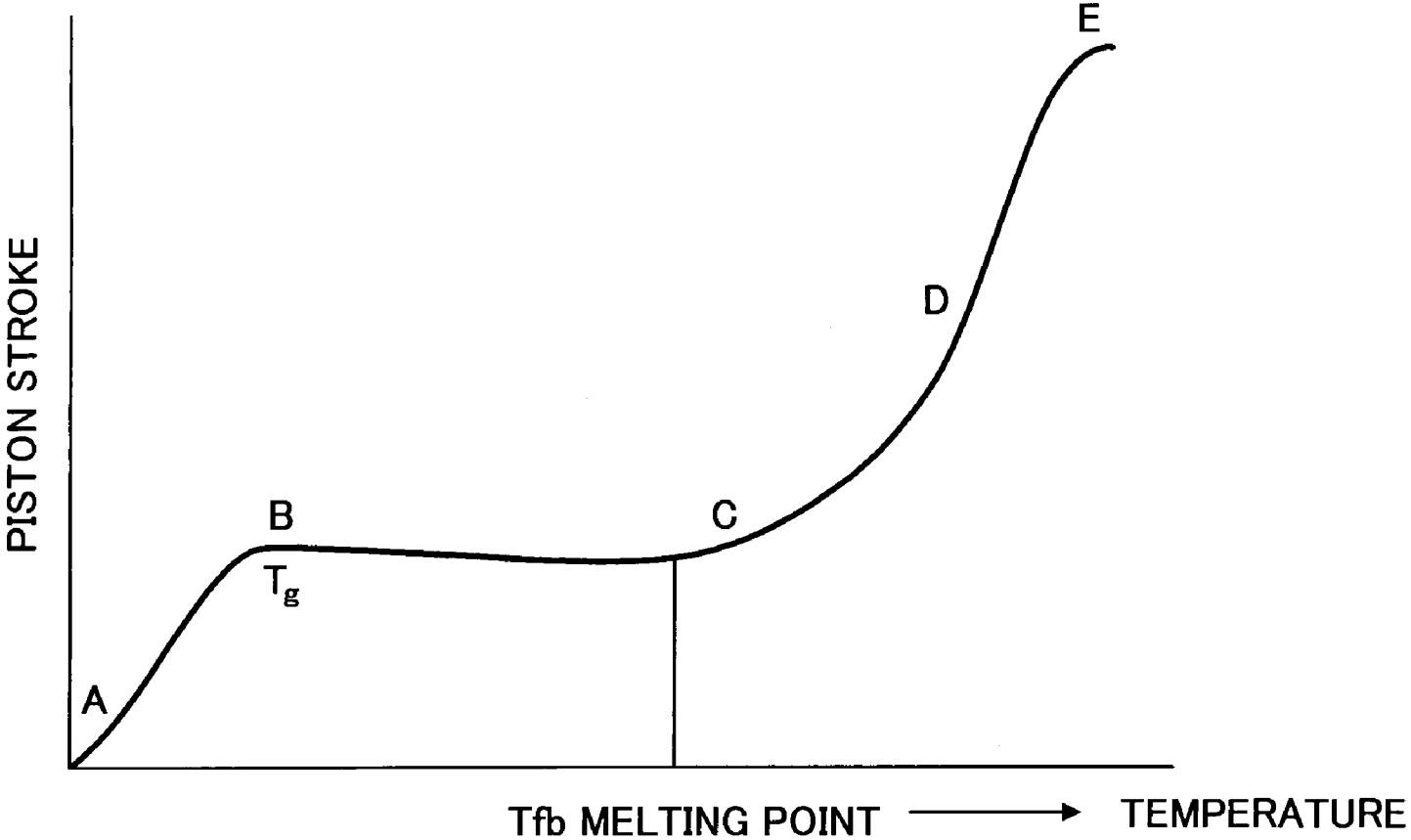
FIG. 2 is a chart for explaining thermal (flow tester) properties of a toner.
Figure 3:
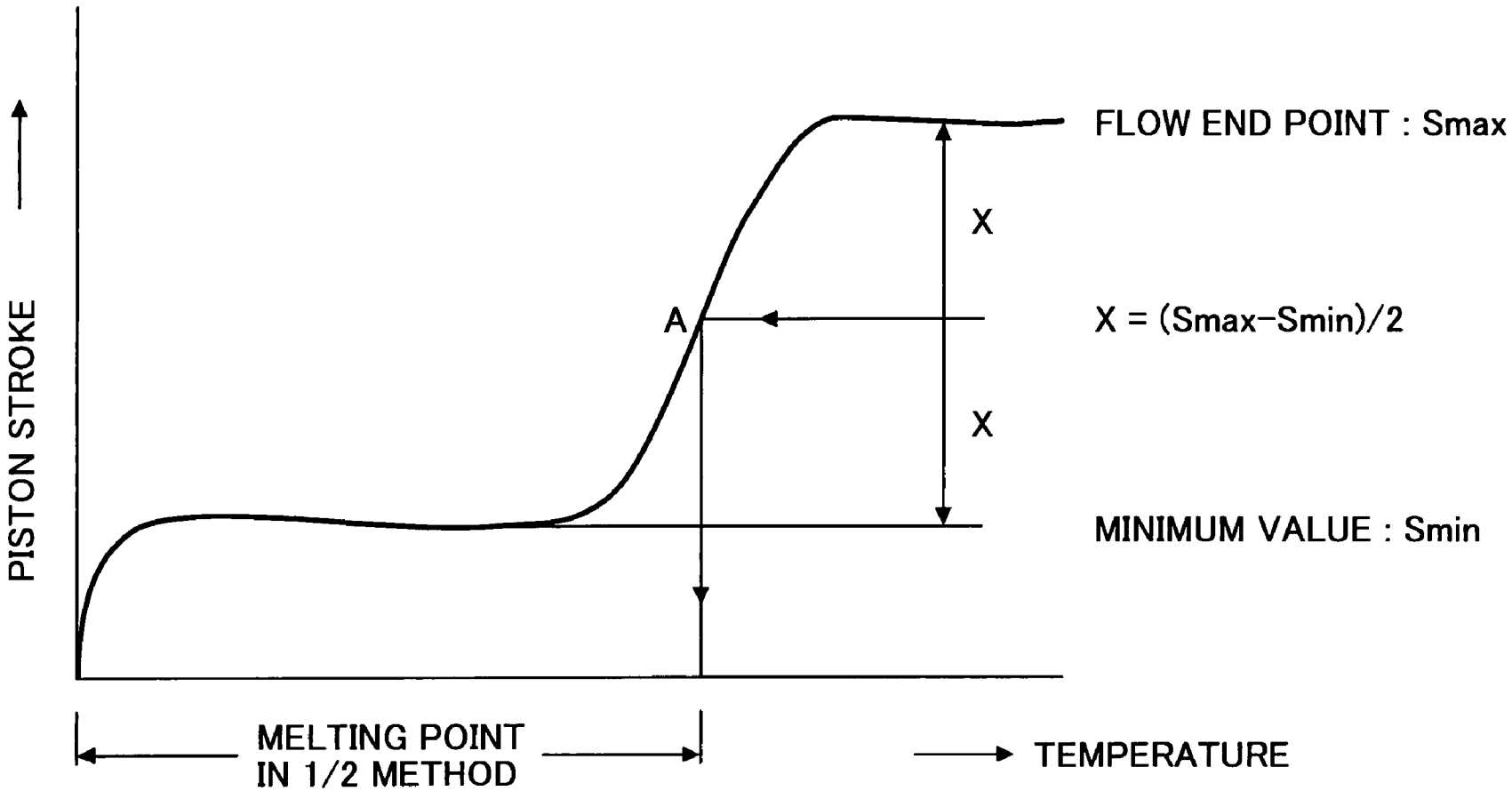
FIG. 3 is a chart for explaining thermal (flow tester) properties of a toner.
Figure 4:
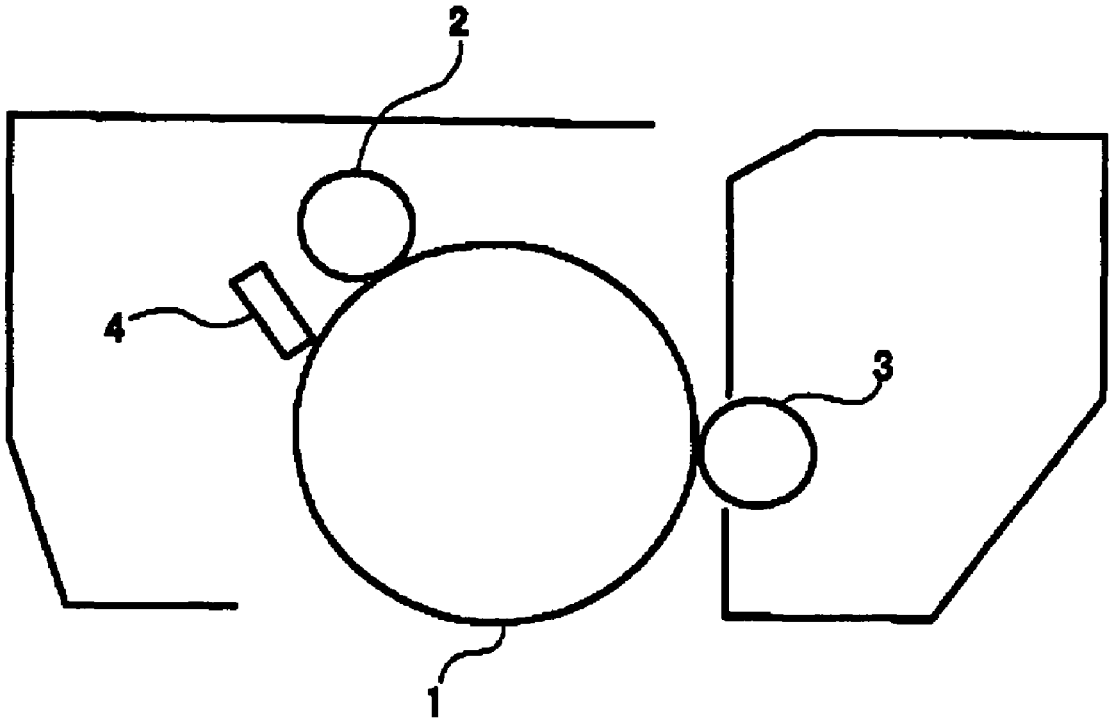
FIG. 4 is a schematic view of a process cartridge of the invention.

Specific examples of a flow tester that may be used to measure the thermal properties of the toner include an elevated flow tester CFT500 from Shimadzu Corp. Flow curves of the flow tester are shown in FIGS. 2 and 3, from which respective temperatures can be read. In FIG. 2, Ts is a softening point and Tfb is a flow starting temperature. In FIG. 3, a melting point in a ½ method is a $F_{1/2}$ temperature. The measuring conditions are as follows:

Load: 10 kg/cm$^2$
Programming rate: 3.0° C./min
Die aperture: 0.50 mm
Die length: 10.0 mm When the melting point and $F_{1/2}$ temperature are lower than 80° C., high temperature preservability of the resultant toner deteriorates and blocking tends to occur at an inner temperature of an image developer. When the melting point is higher than 130° C., the resultant toner does not have good low-temperature fixability because the minimum fixable temperature rises.

The crystalline polymer preferably has an acid value of not less than 8, and more preferably not less than 20 mgKOH/g to have desired low-temperature fixability in terms of affinity between a paper and a resin. On the other hand, the crystalline polymer preferably has an acid value not greater than 45 mgKOH/g to improve hot offset resistance. Further, the crystalline polymer preferably has a hydroxyl value of from 0 to 50, and more preferably of from 5 to 50 mgKOH/g to achieve a predetermined low-temperature fixability and good chargeability.

The crystalline polymer having a CuKα X-ray diffraction spectrum includes at least Bragg angles (2θ) of from 19 to 20±0.2°, 21 to 22±0.2°, 23 to 25±0.2° and 29 to 31±0.2°.

The toner of the present invention preferably includes 1 to 50 parts by weight of the crystalline polymer and 100 parts by weight of the thermoplastic resin to realize low-temperature fixability. When a content of the crystalline polymer is less than 1 part by weight, low-temperature fixability of the resultant toner and scratch resistance of a fixed image deteriorate. When a content of the crystalline polymer is greater than 50 parts by weight, hot offset resistance of the resultant toner and scratch resistance of a fixed image deteriorate.

Known thermoplastic resins can be used in the present invention. Specific examples of the resin include polymers of monomers, copolymers formed from two or more of the monomers or mixtures of the monomers such as styrene, parachlorostyrene, vinyltoluene, vinyl chloride, vinyl acetate, vinyl propionate, (metha)methylacrylate, (metha) ethylacrylate, (metha)propylacrylate, (metha)n-butylacrylate, (metha)isobutylacrylate, (metha)dodecylacrylate, (metha)2-ethylhexylacrylate, (metha)laurylacrylate, (metha)

2-hydroxyethylacrylate, (metha)hydroxypropylacrylate, (metha)2-chloroethylacrylate, (metha)acrylic nitrile acid, (metha)acrylamide, (metha)acrylic acid, vinylmethylether, vinylethylether, vinylisobutylether, vinylmethylketone, N-vinylpyrrolidone, N-vinylpyridine and butadiene. Besides these resins, a polyester resin, a polyol resin, a polyurethane resin, a polyamide resin, an epoxy resin, a rosin, a modified rosin, a terpene resin, a phenol resin, a hydrogenerated petroleum resin, etc. can be used alone or in combination. The term (metha) is used herein to indicate that a methyl group may optionally be present.

Among these resins, the polyester resins, polyol resins, polystyrene resins and styrene-acrylic copolymer resins are preferably used. The polyol resin is a polyetherpolyol resin having an epoxy skeleton, and the epoxy resin, an adduct of a divalent phenol with an alkylene oxide or its glycidylether and a polyol resin formed from a reaction between a compound having an active hydrogen and an epoxy resin are preferably used.

The thermoplastic resin preferably has a sharp molecular weight distribution and a low molecular weight to have good low-temperature fixability, and a THF (tetrahydrofuran) soluble component thereof preferably has a molecular weight distribution (polystyrene converted) of from 2,000 to 90,000 as weight-average molecular weight (Mw).

The glass transition temperature (Tg) is preferably low so as not to deteriorate high temperature preservability of the resultant toner, and preferably from 30 to 90° C., and more preferably from 30 to 80° C. When the glass transition temperature (Tg) is lower than 30° C., high temperature preservability of the resultant toner deteriorates and blocking tends to occur at an inner temperature of the image developer. When higher than 90° C., the resultant toner does not have particularly good low-temperature fixability.

Known waxes can be used as a release agent. Specific examples of the wax include low-molecular-weight polyolefin waxes such as low-molecular-weight polyethylene and low-molecular-weight polypropylene; carbon hydride waxes such as Fischer-Tropsch wax; natural waxes such as bees wax, carnauba wax, candelilla wax, rice wax, Montan wax; petroleum waxes such as paraffin wax and microcrystalline waxes; higher fatty acids such as stearic acid, palmitic acid and myristic acid and their metallic salts; higher fatty acid amide; synthetic ester wax and their modified waxes.

Among these waxes, the carnauba wax and its modified wax, polyethylene wax and synthetic ester wax are preferably used. Particularly, ester pentaerythritoltetrabehenate which is one of the synthetic ester wax is most preferably used. This is because the carnauba wax and its modified wax, polyethylene wax and synthetic ester wax are finely dispersed in a polyester resin and a polyol resin, and the resultant toner has good offset resistance, transferability and durability.

These waxes can be used alone or in combination, and preferably have a melting point of from 70 to 125° C. When the melting point is not less than 70° C., the resultant toner has good transferability and durability. When the melting point is not greater than 125° C., the wax quickly melts when a toner is fixed and exerts its release effect.

The release agent is preferably used in an amount of from 2 to 15% by weight based on total weight of the toner. When the amount is less than 2% by weight, the resultant toner does not have sufficient offset resistance. When greater than 15%, transferability and durability thereof deteriorate.

In terms of transferability and durability, the wax— or the crystalline polymer-containing polymer toner preferably has a maximum average particle diameter of not greater than a half, and more preferably not greater than ⅓ of a maximum particle diameter of the toner at a long axis diameter. However, the maximum average particle diameter is less than 0.5 μm at a long axis diameter, mutually solved part is so large that the resultant toner does not have sufficient high temperature preservability and offset resistance because the wax does not easily exude when the toner is fixed.

Known pigments and dyes capable of preparing a yellow, a magenta, a cyan and a black toner can be used as the colorant.

Specific examples of the yellow pigments include cadmium yellow, Pigment Yellow 155, benzimidazolone, Mineral Fast Yellow, Nickel Titan Yellow, naples yellow, Naphthol Yellow S, Hansa Yellow G, Hansa Yellow 10G, Benzidine Yellow GR, Quinoline Yellow Lake, Permanent Yellow NCG, Tartrazine Lake, etc.

Specific examples of the orange color pigments include Molybdenum Orange, Permanent Orange GTR, Pyrazolone Orange, Vulcan Orange G, Indanthrene Brilliant Orange GK, etc.

Specific examples of the red pigments include red iron oxide, quinacridone red, cadmium red, Permanent Red 4R, Lithol Red, Pyrazolone Red, Watching Red calcium salts, Lake Red D, Brilliant Carmine 6B, Eosine Lake, Rhodamine Lake B, Alizarine Lake, Brilliant Carmine 3B, etc.

Specific examples of the violet pigments include Fast Violet B, Methyl Violet Lake, etc.

Specific examples of the blue pigments include cobalt blue, Alkali Blue, Victoria Blue Lake, Phthalocyanine Blue, metal-free Phthalocyanine Blue, partialy chlorinated Phthalocyanine Blue, Fast Sky Blue, Indanthrene Blue BC, etc.

Specific examples of the green pigments include a chrome green, chrome oxide, Pigment Green B, Malachite Green Lake, etc.

Specific examples of the black pigments include azine pigments such as carbon black, oil furnace black, channel black, lamp black, acetylene black and aniline black, metal salts of azo pigments, metal oxides, complex metal oxides, etc.

These pigments are used alone or in combination.

The toner of the present invention can optionally include a charge controlling agent.

Specific examples of the charge controlling agents include Nigrosin; azine dyes including an alkyl group having 2 to 16 carbon atoms disclosed in Japanese Patent Publication No. 42-1627; basic dyes (e.g. C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), Basic Blue 26 (C.I. 44045), C.I. Basic Green 1 (C.I. 42040) and C.I. Basic Green 4 (C.I. 42000)); lake pigments of these basic dyes; C.I. Solvent Black 8 (C.I. 26150); quaternary ammonium salts such as benzoylhexadecylammonium chlorides and decyltrimethyl chlorides; dialkyl tin compounds such as dibuthyl or dioctyl tin compounds; dialkyl tin borate compounds; guanidine derivatives; vinyl polymers including amino groups, polyamine resins such as condensation polymers including an amino group, metal complexes of mono azo dyes disclosed in Japanese Patent Publications Nos. 41-20153, 43-27596, 44-6397 and 45-26478; metal complexes of dicarboxylic acid such as Zn, Al, Co, Cr, and Fe complexes of salicylic acid, dialkylsalicyic acid and naphtoic acid;

sulfonated copper phthalocyanine pigments, organic boric salts, quaternary ammonium salts including a fluorine atom, calixarene compounds, etc. For a color toner besides a black toner, a charge controlling agent impairing the original color should not be used, and white metallic salts of salicylic acid derivatives are preferably used.

Transferability and durability of the toner of the present invention are further improved by externally adding inorganic fine particles such as silica, titanium oxide, alumina, silicon carbonate, silicon nitride and boron nitride and resin fine particles onto a surface of a mother toner particle.

It is thought that these external additives may cover any wax protein on the surface of the toner which may deteriorate transferability and durability decreasing the area a toner particle may be in contact with another toner particle. The inorganic fine particles are preferably hydrophobized, and hydrophobized fine particles of metal oxide such as silica and titanium oxide are preferably used. The resin fine particles such as polymethylmethacrylate and polystyrene fine particles having an average particle diameter of from 0.05 to 1 μm, which are formed by a soap-free emulsion polymerization method, are preferably used. Further, a toner including the hydrophobized silica and hydrophobized titanium oxide as external additives, wherein an amount of the hydrophobized silica is larger than that of the hydrophobized titanium oxide, has good charge stability against humidity.

A toner including the above-mentioned inorganic fine particles and external additives having a particle diameter larger than that of conventional external additives such as silica having a specific surface area of from 20 to 50 $m^2/g$ and resin fine particles having an average particle diameter of from 1/100 to 1/8 to that of the toner, has good durability.

It is thought this may be due to the prevention of fine particles of metal oxide being buried into a mother toner particle which has a particle diameter larger than that of the fine particles of metal oxide, although the fine particles of metal oxide externally added to a toner tend to be buried into the mother toner particle while the toner is mixed and stirred with a carrier, and charged to develop an image in an image developer.

A toner internally including the inorganic fine particles and resin fine particles has improved pulverizability as well as transferability and durability although less improved than the toner externally including them. When the external and internal additives are used together, it can be prevented that the external additives are buried into the mother toner particle and the resultant toner stably has good transferability and durability.

Specific examples of the hydrophobizing agents include dimethyldichlorosilane, trimethylchlorosilane, methyltrichlorosilane, allyldimethylchlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxylsilane, vinyltriethoxysilane, vinylmethoxysilane, vinyl-tris(β-methoxyethoxy)silane, γ-methacryloxypropyltrimethoxysilane, vinyltriacetoxysilane, divinyldichlorosilane, dimethylvinylchlorosilane, octyl-trichlorosilane, decyl-trichlorosilane, nonyl-trichlorosilane, (4-tert-propylphenyl)-trichlorosilane, (4-tert-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-tert-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-tert-propylphenyl)-diethyl-chlorosilane, octyltrimethoxysilane, hexamethyldisilazane, hexaethyldisilazane, hexatolyldisilazane, etc. Besides these agents, titanate coupling agents and aluminium coupling agents can be used.

Besides, as an external additive for the purpose of improving cleanability, lubricants such as fine particles of aliphaticmetallic salts and polyvinylidene fluoride can be used.

The toner of the present invention can be used both for a one-component developer and a two-component developer. When the toner is used for the two-component developer, the toner is mixed with a carrier powder. Any known carrier such as an iron powder, a ferrite powder, a magnetite powder, a nickel powder, glass beads and these materials coated with a resin can be used. The carrier preferably has a volume-average particle diameter of from 25 to 200 μm.

A toner container of the present invention is filled with the one-component or two-component developer including the toner of the present invention, and any known shapes thereof can be used.

A method of preparing the toner of the present invention is not particularly limited, and known methods such as a melting and kneading pulverization method; a polymerization method; a polyaddition reaction method using a prepolymer including an isocyanate group; a method of dissolving with a solvent, removing the solvent and pulverizing; and a melting spray method can be used. Among these methods, the melting and kneading pulverization method, polymerization method, polyaddition reaction method using a prepolymer including an isocyanate group, and method of dissolving with a solvent, removing the solvent and pulverizing are preferably used.

As an apparatus for melting and kneading a toner, a batch type two-roll kneading machine, a Banbury's mixer, a continuous biaxial extrusion machine such as KTK biaxial extrusion machines from Kobe Steel, Ltd., TEM biaxial extrusion machines from Toshiba Machine Co., Ltd., TEX biaxial extrusion machines from Japan Steel Works, Ltd., PCM biaxial extrusion machines from Ikegai Corporation and KEX biaxial extrusion machines from Kurimoto, Ltd. and a continuous one-axis kneading machine such as KO-KNEADER from Buss AG are preferably used.

In the polymerization method and polyaddition reaction method using a prepolymer including an isocyanate group, a compulsory emulsification (formation of a liquid drop) by providing a mechanical energy in an aqueous phase is essential. Specific examples of means of providing such mechanical energy include strong stirrers such as a homomixer and ultrasonic vibration energy providers.

A hammer mill, rotoplex, etc. crush, and jet stream and mechanical pulverizers pulverize a toner material to preferably have an average particle diameter of from 3 to 15 μm. Further, the pulverized materials are classified into the materials having particle diameters of from 5 to 20 μm by a wind-force classifier, etc.

An external additive and a mother toner particle are mixed and stirred by a mixer such that the external additive is pulverized to cover a surface of the mother toner particle. It is essential that the external additives such as inorganic fine particles and resin fine particles are uniformly and firmly adhered to the mother toner particle to improve durability of the resultant toner.

Specific examples of organic solvents for use in the present invention include toluene, ethylacetate, butylacetate, methyl ethyl ketone, tetrahydrofuran, etc.

When the toner of the present invention is prepared by the polymerization method, a radical polymerizable monomer is an essential component to obtain a thermoplastic resin as a binder resin forming the toner and a crosslinker can optionally be used. At least one of the following radical polymerizable monomers having an acidic group or a basic group is preferably used.

The radical polymerizable monomers are not particularly limited, and known radical polymerizable monomers can be used. These can be used alone or in combination. Specific examples of the radical polymerizable monomers include aromatic vinyl monomers, (metha) esteracrylate monomers, vinylester monomers, vinylether monomers, mono-olefin monomers, diolefin monomers, halogenated olefin monomers, etc. Specific examples of the aromatic vinyl monomers include styrene monomers and their derivatives such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene. Specific examples of the (metha)esteracrylate monomers include methylacrylate, ethylacrylate, butylacrylate, 2-ethylhexylacrylate, cyclohexylacrylate, phenylacrylate, methylmethacrylate, ethylmethacrylate, butylmethacrylate, hexylmethacrylate, 2-ethylhexylmethacrylate, β-hydroxyethylacrylate, γ-aminopropylacrylate, stearylmethacrylate, dimethylaminoethylmethacrylate and diethylaminoethylmethacrylate. Specific examples of the vinylether monomers include vinylmethylether, vinylethylether, vinylisobutylether, vinylphenylether, etc. Specific examples of the mono-olefin monomers include ethylene, propylene, isobutylene, 1-buten, 1-pentene, 4-methyl-1-pentene, etc. Specific examples of the diolefin monomers include butadiene, isoprene, chloroprene, etc. Specific examples of the halogenated olefin monomers include vinylchloride, vinylidenechloride, vinylbromide, etc.

A radical polymerizing crosslinker maybe included in toner materials to improve properties thereof. Specific examples of the radical polymerizing crosslinker include crosslinkers having 2 or more unsaturated bonds such as divinylbenzene, divinylnaphthalene, divinylether, diethyleneglycolmethacrylate, ethyleneglycoldimethacrylate, polyethyleneglycoldimethacrylate and diallylphthalate.

Specific examples of the radical polymerizable monomer having an acidic group or a basic group include amine compounds such as a monomer including a carboxyl group, a monomer including a sulfonic acid group, primary amine, secondary amine, third amine and quaternary ammonium salts. Specific examples of the radical polymerizable monomer having an acidic group include an acrylic acid, a methacrylic acid, a fumaric acid, a maleic acid, an itaconic acid, a cinnamic acid, monobutylestermaleate, monooctylestermaleate, etc. as a monomer including a carboxylic acid group. Specific examples of the monomer including a sulfonic acid group include a styrene sulfonic acid, an acrylsulfo succinic acid, octyl acrylsulfo succinate, etc. These may have a structure of an alkali metal salt such as sodium and kalium or an alkali earth metal salt such as calcium.

Specific examples of the radical polymerizable monomer having a basic group include amine compounds such as dimethylaminoethylacrylate, dimethylaminoethylmethacrylate, diethylaminoethylacrylate, diethylaminoethylmethacrylate and their quaternary ammonium salts, 3-diethylaminophenylacrylate, 2-hydroxy-3-methacryloxypropyltrimethylammonium salt, acrylamide, N-butylacrylamide, N,N-dibutylacrylamide, piperidylacrylamide, methacrylamide, N-butylmethacrylamide, N-octadecylacrylamide, vinylpyridine, vinylpyrrolidone, vinylN-methylpyridiniumchloride, vinylN-ethylpyridiniumchloride, N,N-diallylmethylammoniumchloride and N,N-diallylethylammoniumchloride.

A content of the radical polymerizable monomer having an acidic group or a basic group is preferably from 0.1 to 15% by weight based on total weight of monomers in the toner of the present invention. A content of the radical polymerizing crosslinker is preferably from 0.1 to 10% by weight based on total weight of the radical polymerizable monomers.

A chain transfer agent typically used can be used for the purpose of controlling molecular weight of the binder resin. The chain transfer agents are not particularly limited, and specific examples thereof include mercaptan such as octylmercaptan, dodecylmercaptan and tert-dodecylmercaptan; styrene dimer, etc.

A radical polymerization initiator for use in the present invention is not particularly limited, and a water-soluble and oil-soluble polymerization initiators can optionally be used. Specific examples of the water-soluble polymerization initiators include persulfate salts such as potassiumpersulfate and ammonium persulfate; azo compounds such as 4,4-azobis-4-cyanovaleric acid and its salt, and 2,2'-azobis(2-amidinopropane)salt; and peroxide compounds. Further, the polymerization initiator can optionally be combined with a reducer to form a redox initiator. The redox initiator increases polymerization activation, decreases polymerization temperature and shortens polymerization time. Any temperature can be selected as the polymerization temperature provided it is not less than a minimum radical generation temperature of the polymerization initiator, and typically of from 50 to 90° C. Polymerization can be performed at a room temperature or more when a room temperature polymerization initiator such as a combination of hydrogen peroxide and a reducer (an ascorbic acid) is used.

Emulsion polymerization using the radical polymerizable monomers may need a surfactant. The surfactant is not particularly limited, and the following ionic surfactants are preferably used. Specific examples of the ionic surfactants include salts sulfonate such as sodium dodecylbenzenesulfonate, sodium arylalkylpolyethersufonate, 3,3-disulfonediphenylurea-4,4-diazo-bis-amino-8-naphthol-6-sodium sulfonate, ortho-carboxybenzene-azo-dimethylaniline, and 2,2,5,5-tetramethyl-triphenylmethane-4,4-diazo-bis-β-naphthol-6-sodium sulfonate; salts of ester sulfate such as dodecyl sodium sulfate, tetradecyl sodium sulfate, pentadecyl sodium sulfate and octyl sodium sulfate; and fatty acid salts such as sodium oleate, sodium laurate, sodium caprate, sodium caprylate, sodium caproate, potassium stearate and calcium oleate. In addition, nonionic surfactants can also be used. Specific examples of the nonionic surfactants include polyethylene oxide, polypropylene oxide, a combination thereof, ester of polyethyleneglycol and a higher fatty acid, alkylphenolpolyethyleneoxide, ester of a higher fatty acid and polypropyleneoxide, sorbitan ester, etc. In the present invention, these surfactants are mostly used as emulsifiers in emulsifying polymerization, and maybe used for other processes or purposes.

Specific examples of the prepolymer including a isocyanate group include a polyester prepolymer, an epoxy resin prepolymer, polyurethane prepolymer, polyamide prepolymer including an isocyanate group, etc. Among these prepolymers, the polyester prepolymer, epoxy resin prepolymer and polyurethane prepolymer are preferably used, the polyester prepolymer and epoxy resin prepolymer are more preferably used, and the polyester prepolymer is most preferably used.

Specific examples of the polyester prepolymer including an isocyanate group include a polymer formed from a reaction between polyester having an active hydrogen atom formed by polycondensation between polyol and a polycarboxylic acid, and polyisocyanate. Specific examples of the groups including the active hydrogen include a hydroxyl group (an alcoholic hydroxyl group and a phenolic hydroxyl group), an amino group, a carboxyl group, a mercapto group, etc. In particular, the alcoholic hydroxyl group is preferably used.

As the polyol, diol and polyol having 3 valences or more can be used, and the diol alone or a mixture of the diol and a small amount of the polyol having 3 valences or more is preferably used. Specific examples of the diol include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, alkylene glycol having 2 to 12 carbon atoms and adducts of bisphenol with an alkylene oxide are preferably used, and a mixture thereof is more preferably used. Specific examples of the polyol having 3 valences or more include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarboxylic acid, dicarboxylic acid and polycarboxylic acid having 3 or more valences can be used. Dicarboxylic acid alone, or a mixture of the dicarboxylic acid and a small amount of the polycarboxylic acid having 3 or more valences are preferably used. Specific examples of the dicarboxylic acid include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the polycarboxylic acid having 3 or more valences include aromatic polycarboxylic acids having 9 to 20 carbon atoms such as a trimellitic acid and a pyromellitic acid. The polycarboxylic acid can also be formed from a reaction between the above-mentioned acids anhydride or lower alkyl ester such as methyl ester, ethyl ester and isopropyl ester.

Polyol and polycarboxylic acid are mixed such that an equivalent ratio (OH/COOH) between a hydroxyl group [OH] and a carboxylic group [COOH] is typically from 2/1 to 1/1, preferably from 1.5/1 to 1/1 and more preferably from 1.3/1 to 1.02/1.

Specific examples of the polyisocyanate include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; aromatic diisocyanate such as tolylenedisocyanate and diphenylmethanediisocyanate; aroma aliphatic diisocyanate such as α, α, α',α'-tetramethylxylylenediisocyanate; isocyanurate; the above-mentioned polyisocyanate blocked with phenol derivatives, oxime and caprolactam; and their combinations.

Specific examples of the amines include polyamines (B1), blocked polyamines with a releasable compound (B2), amino alcohols (B3), amino mercaptans (B4), amino acids (B5) and blocked amines (B6) in which the amino groups of (B3) to (B5) mentioned above are blocked with a releasable compound. Specific examples of the polyamines (B1) include diamines (B1-1) and polyamines having 3 or more valences (B1-2). Specific examples of the diamines (B1-1) include aromatic diamines such as phenylene diamine, diethyltoluene diamine and 4,4'-diaminodiphenyl methane; alicyclic diamines such as 4,4'-diamino-3,3'-dimethyldicyclohexyl methane, diaminecyclohexane and isophoronediamine; and aliphatic diamines such as ethylene diamine, tetramethylene diamine and hexamethylene diamine; etc. Specific examples of the polyamines (B1-2) having three or more valences include diethylene triamine, triethylene tetramine, etc. Specific examples of the blocked polyamines with a releasable compound (B2) include ketimine compounds which are prepared by reacting one of the polyamines (B1) mentioned above with a ketone such as acetone, methyl ethyl ketone and methyl isobutyl ketone; oxazoline compounds, etc. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) in which the amino groups of (B3) to (B5) include ketimine compounds which are prepared by reacting one of (B3) to (B5) with a ketone such as acetone, methyl ethyl ketone and methyl isobutyl ketone; oxazoline compounds, etc. Among these amines, (B1) and (B2) are preferably used. A mixture of (B1-1) and a small amount of (B1-2), and their ketones and ketimine compounds are more preferably used. Ketimine compounds of (B1) are most preferably used.

Further, an elongation anticatalyst can optionally be used with the amines. Specific examples of the elongation anticatalyst include monoamines such as diethyle amine, dibutyl amine, butyl amine and lauryl amine, and blocked amines, i.e., ketimine compounds prepared by blocking the monoamines mentioned above.

FIG. (4) is a schematic view illustrating an embodiment of the process cartridge of the present invention, which may be detachably installed in a copier or an image forming apparatus. In FIG. (4), numeral 1 is a photoreceptor, 2 is a charger, 3 is an image developer and 4 is a cleaner.

In the present invention, the process cartridge includes the photoreceptor and at least one of the charger, image developer and cleaner.

Image Forming Apparatus

In an image forming apparatus of one embodiment of the invention including the process cartridge of the present invention, a photoreceptor is rotated at a predetermined peripheral speed. A peripheral surface of the photoreceptor is uniformly and positively or negatively charged by the charge when rotated. Then, the peripheral surface of the photoreceptor is irradiated with an imagewise light by a slit irradiator, a laser beam scanning irradiator, etc. to form an electrostatic latent image thereon. The electrostatic latent image is developed by an image developer form a toner image on the peripheral surface of the photoreceptor. The toner image is transferred onto a transfer sheet fed between the photoreceptor and a photoreceptor. The transfer sheet on which the toner image is transferred separates from the peripheral surface of the photoreceptor and fed to an image fixer to fix the toner image thereon, and fed out of the apparatus as a duplicate copy. The peripheral surface of the photoreceptor is cleaned by a cleaner to remove a residual toner after transferred, and is discharged to be prepared for forming the following image. In FIG. 1, numeral 1 is a photoreceptor (an image bearer), 2 is a charging roller, 3 is an image developer, 4 is a developer, 5 is a developing sleeve (a developer bearer), 6 is a transfer belt (transferer), 6*a* is a bias roller, 7 is a cleaning blade, 8 is a collection spring, 9 is a collection coil, 10 is a photoreceptor and cleaning unit, 13 is a feeding screw, 14 is a paddle (stirrer), 16 is a reflection density detector, 17 is a toner concentration sensor, 18 is a resist roller, 20 is a discharging lamp and 20 is a transfer sheet.

Hereinafter, methods of measuring values of properties of a resin and a toner for use in the present invention will be explained.

Melting Point of Crystalline Polymer

DSC-60A from Shimadzu Corp. was used at a temperature of from room temperature to 200° C. at a programming speed of 10° C./min. A peak temperature showing a maximum endothermic amount was determined as a melting point.

Acid Value and Hydroxyl Value

Measuring methods of an acid value and a hydroxyl value of a resin are based on the methods specified in JIS K0070. However, when a sample was not dissolved, solvents such as dioxane, THF and o-dichlorobenzene were used.

Powder X-Ray Diffraction

RINT1100 having a Cu bulb and a tube voltage and current of 50 kV and 30 mA, and a wide-angle goniometer were used to measure a powder X-ray diffraction.

Pulverizability

An air pulverizer was used to pulverize a toner material in fixed conditions and pulverized particle diameter was measured. The smaller the particle diameter, the better the pulverizability.

◎: much better than a conventional toner

○: better than a conventional toner

Δ: equal to a conventional toner

X: inferior to a conventional toner

Measurement of Molecular Weight by GPC Using THF as a Solvent

A column was stabilized in a heat chamber having a temperature of 40° C.; THF was put into the column at a speed of 1 ml/min as a solvent; 50 to 200 μl of a THF liquid-solution of a resin, having a sample concentration of from 0.05 to 0.6% by weight, was put into the column; and a molecular weight distribution of the sample was determined by using a calibration curve which is previously prepared using several polystyrene standard samples having a single distribution peak, and which shows the relationship between a count number and the molecular weight.

As the standard polystyrene samples for making the calibration curve, for example, the samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $48\times10^6$ from Pressure Chemical Co. or Tosoh Corporation are used. It is preferable to use at least 10 standard polystyrene samples. In addition, an RI (refraction index) detector is used as the detector.

Measurement of Molecular Weight by GPC Using o-dichlorobenzene as a Solvent

A column was stabilized in a heat chamber having a temperature of 145° C.; o-dichlorobenzene including BHT of 0.3% concentration as an eluent was put into the column at a speed of 1 ml/min; 50 to 200 μl of an o-dichlorobenzene liquid-solution of a resin, having a sample concentration of 0.3% by weight and a temperature of 140° C., was put into the column. A measurer type 150CV from Waters and two pieces of a column Shodex AT-G+At-806MS can be used. A molecular weight distribution of the sample was determined by using a calibration curve which is previously prepared using several polystyrene standard samples having a single distribution peak, and which shows the relationship between a count number and the molecular weight. A slice width is 0.05 sec. As the standard polystyrene samples for making the calibration curve, for example, the samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $48\times10^6$ from Pressure Chemical Co. or Tosoh Corporation are used. It is preferable to use at least 10 standard polystyrene samples. In addition, an RI (refraction index) detector is used as the detector.

High Temperature Preservability

After a toner was stored at 50° C. for 8 hrs, the toner was sieved with a mesh No. 42 for 2 min and a residual ratio thereof on the mesh was determined as the high temperature preservability. The smaller the residual ratio, the better the high temperature preservability.

◎: much better than a conventional toner

○: better than a conventional toner

Δ: equal to a conventional toner

X: inferior to a conventional toner

Hot Offset Generation Temperature

A modified Ricoh color copier PRETER 650 in which a fixing roller is changed to a PFA coated roller, and from which a silicone oil applicator is removed was used. A temperature of the fixing roller was changed by a unit of 5° C. to measure a temperature at which an offset starts to occur. An oil was not applied to the fixing roller and Ricoh full color PPC paper type 6000 (70 W) was used as a transfer sheet. The evaluations were made as follows:

◎: offset does not occur even at quite a high temperature, and the toner has very good offset resistance.

○: offset does not occur at a high temperature, and the toner has good offset resistance.

Δ: offset resistance is insufficient, but is satisfactory when a small amount of a silicone oil is applied to the fixing roller (0.5 to 1 mg/A4).

X: offset occurs at a low temperature and offset resistance is poor even when a small amount of a silicone oil is applied to the fixing roller.

Low-temperature Fixability

In the same method of evaluating offset resistance, the fixing temperature was changed to produce copy images having an image density of 1.2 when measured by a Macbeth densitometer.

Image density before and after the copy images produced at respective temperatures were scraped by a clock meter equipped with a sand eraser for 10 times were measured to determine fixability in the following formula:

fixability (%)=image density after scrape/image density before scrape×100

A temperature to achieve fixability of 70% or more was determined as a minimum fixable temperature. The low-temperature fixability was evaluated as follows:

◎: toner starts to fix at quite a low temperature, has a low minimum fixable temperature and good low-temperature fixability.

○: toner has good low-temperature fixability.

Δ: toner has a similar minimum fixable temperature to that of a conventional toner.

X: toner has a higher minimum fixable temperature than that of a conventional toner, and has poor low-temperature fixability.

Dispersibility

A dispersed status of a toner composition was visually or with a SEM or a TEM observed and evaluated. The evaluations were made as follows:

◎: a dispersion time is short and the dispersed status is very good.

○: a dispersion time is short and the dispersed status is good.

Δ: similar to a conventional toner.

X: inferior to a conventional toner

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis Example 1

Synthesis of a Crystalline Polyester Resin No. 1

In a 5 liter four-opening flask equipped with a nitrogen inlet tube, a dewatering tube, a stirrer and a thermocouple, 25 moles of 1,4-butanediol, 23.75 moles of fumaric acid, 1.65 moles of trimellitic acid anhydride and 5.3 g of hydroquinone were reacted for 5 hrs at 160° C. The mixture was further reacted for 1 hr at 200° C. and was reacted at 8.3 KPa for 1 hr to prepare a crystalline polyester resin No. 1. The crystalline polyester resin No. 1 had a melting point of 119° C., a Mn of 710, a Mw of 2,100, an acid value of 24 and a hydroxyl value of 28.

Synthesis Examples 2 to 9

Syntheses of Crystalline Polyester Resins Nos. 2 to 9

The procedures of preparation for the crystalline polyester resin No. 1 in Synthesis Example 1 were repeated to prepare crystalline polyester resins Nos. 2 to 9 except for changing the materials to the following materials.

| No. 2 | |
|---|---|
| 1,4-butanediol | 25 moles |
| Fumaric acid | 21.25 moles |
| Trimellitic acid anhydride | 5 moles |
| Hydroquinone | 5.7 g |

The crystalline polyester resin No. 2 had a melting point of 96° C., a Mn of 620, a Mw of 1,750, an acid value of 37 and a hydroxyl value of 8.

| No. 3 | |
|---|---|
| 1,4-butanediol | 23.75 moles |
| Ethyleneglycol | 1.25 moles |
| Fumaric acid | 22.75 moles |
| Trimellitic acid anhydride | 1.65 moles |
| Hydroquinone | 4.8 g |

The crystalline polyester resin No. 3 had a melting point of 128° C., a Mn of 1,650, a Mw of 6,400, an acid value of 24 and a hydroxyl value of 44.

| No. 4 | |
|---|---|
| 1,4-butanediol | 22.5 moles |
| Ethyleneglycol | 5 moles |
| Fumaric acid | 23.75 moles |
| Trimellitic acid anhydride | 5 moles |
| Hydroquinone | 5.8 g |

The crystalline polyester resin No. 4 had a melting point of 82° C., a Mn of 1,100, a Mw of 4,700, an acid value of 25 and a hydroxyl value of 33.

| No. 5 | |
|---|---|
| 1,4-butanediol | 25 moles |
| Fumaric acid | 22.5 moles |
| Trimellitic acid anhydride | 1.65 moles |
| Hydroquinone | 5.3 g |

The crystalline polyester resin No. 5 had a melting point of 113° C., a Mn of 780, a Mw of 2,400, an acid value of 22 and a hydroxyl value of 28.

| No. 6 | |
|---|---|
| 1,4-butanediol | 23.75 moles |
| 1,6-hexanediol | 1.25 moles |
| Fumaric acid | 23 moles |
| Maleic acid | 0.75 moles |
| Trimellitic acid anhydride | 1.65 moles |
| Hydroquinone | 5.2 g |

The crystalline polyester resin No. 6 had a melting point of 128° C., a Mn of 850, a Mw of 3,450, an acid value of 28 and a hydroxyl value of 22.

Example 1

Toner Production by a Kneading and Pulverizing Method

After the following toner composition for sufficiently mixed by a blender, the mixture was kneaded upon application of heat by a biaxial extruder at 140° C. for 30 min. Then, the mixture was pulverized and classified to prepare a mother toner having a volume-average particle diameter of about 7.6 μm. 0.4 parts of a hydrophobic silica having a hexamethyldisilazane treated surface and an average primary particle diameter of 0.02 μm as an external additive were mixed with 100 parts of the mother toner by a Henschel mixer to prepare a cyan color toner.

| | |
|---|---|
| Crystalline polyester resin No. 1 | 20 |
| Polyester resin | 70 |
| having a Tg of 59° C. and a Mw of 17,000 | |
| Ester pentaerythritoltetrabehenate | 5 |
| having a melting point of 84.5° C. | |
| Charge controlling agent | 2 |
| (Metallic salt of salicylic acid derivative) | |
| Colorant | 6 |
| (Copper phthalocyanine blue pigment) | |

Examples 2 to 6

The procedure of preparation for the cyan color toner in Example 1 was repeated to prepare respective color toners in Examples 2 to 6 except for changing the toner compositions to the following compositions.

Example 2

| | |
|---|---|
| Crystalline polyester resin No. 2 | 30 |
| Polyester resin | 50 |
| having a Tg of 32° C. and a Mw of 11,000 | |
| Carnauba wax | 5 |
| having a melting point of 84.5° C. | |
| Charge controlling agent | 2 |
| (Metallic salt of salicylic acid derivative) | |
| Colorant | 7.5 |
| (Carbon black) | |

The mother toner had a volume-average particle diameter of about 7.5 μm.

Example 3

| | |
|---|---|
| Crystalline polyester resin No. 3 | 20 |
| Crystalline polybutadiene | 10 |
| having a Tg of 124° C., a Mn of 1,100 and a Mw 4,000 | |
| Polystyrene-acrylate resin | 70 |
| having a Tg of 78° C. and a Mw 85,000 | |
| Polyol resin | 15 |
| having a Tg of 75° C. and a Mw of 15,000 | |
| Polyethylene wax | 5 |
| having a melting point of 123° C. | |
| Charge controlling agent | 2 |
| (Metallic salt of salicylic acid derivative) | |
| Colorant | 10 |
| (quinacridone red) | |

The mother toner had a volume-average particle diameter of about 7.2 μm.

Example 4

| | |
|---|---|
| Crystalline polyester resin No. 4 | 60 |
| Polystyrene resin | 60 |
| having a Tg of 78° C. and a Mw of 35,000 | |
| Ester behenylbehenate | 5 |
| having a melting point of 72° C. | |
| Charge controlling agent | 2 |
| (Metallic salt of salicylic acid derivative) | |

-continued

| | |
|---|---|
| Colorant | 10 |
| (Benzimidazolone) | |

The mother toner had a volume-average particle diameter of about 7.8 μm.

Example 5

| | |
|---|---|
| Crystalline polyester resin No. 5 | 1 |
| Polyester resin | 85 |
| having a Tg of 59° C. and a Mw of 17,000 | |
| Ester pentaerythritoltetrastarate | 5 |
| having a melting point of 74° C. | |
| Charge controlling agent | 2 |
| (Metallic salt of salicylic acid derivative) | |
| Colorant | 6 |
| (Copper phthalocyanine blue pigment) | |

The mother toner had a volume-average particle diameter of about 7.9 μm.

Example 6

| | |
|---|---|
| Crystalline polyester resin No. 6 | 20 |
| Polyester resin | 70 |
| having a Tg of 43° C. and a Mw of 17,000 | |
| Ester pentaerythritoltetrabehenate | 5 |
| having a melting point of 84° C. | |
| Charge controlling agent | 2 |
| (Metallic salt of salicylic acid derivative) | |
| Colorant | 6 |
| (Copper phthalocyanine blue pigment) | |

The mother toner had a volume-average particle diameter of about 7.4 μm.

Comparative Example 1

The procedures of preparation for the toner in Example 1 were repeated to prepare a toner except for excluding the crystalline polyester resin No. 1. The mother toner had a volume-average particle diameter of about 7.1 μm.

Comparative Example 2

The procedures of preparation for the toner in Example 1 were repeated to prepare a toner except for changing the polyester resin to a polyester resin having a Tg of 26° C. and a Mw of 9,200. The mother toner had a volume-average particle diameter of about 9 μm.

Comparative Example 3

The procedures of preparation for the toner in Example 1 were repeated to prepare a toner except for changing the crystalline polyester resin No. 1 to a crystalline polypropylene resin having a Tg of 136° C., a Mn of 760 and a Mw of 2,300. The mother toner had a volume-average particle diameter of about 7.7 μm.

Comparative Example 4

The procedures of preparation for the toner in Example 1 were repeated to prepare a toner except for changing the ester pentaerythritoltetrabehenate to a polypropylene wax having a Tg of 130° C. The mother toner had a volume-average particle diameter of about 8.5 μm.

Example 7

Toner Production by a Solvent Dissolving Method

After the following toner compositions and 245 parts of ethylacetate were mixed in a dissolving tank upon application of heat at a boiling point of the ethylacetate of 81° C. for 1 hr, the mixture was cooled to have a room temperature and the solvent was removed therefrom.

| | |
|---|---|
| Crystalline polyester resin No. 1 | 20 |
| Polyester resin<br>having a Tg of 59° C. and a Mw of 17,000 | 70 |
| Ester pentaerythritoltetrabehenate<br>having a melting point of 84.5° C. | 5 |
| Charge controlling agent<br>(Metallic salt of salicylic acid derivative) | 2 |
| Colorant<br>(Copper phthalocyanine blue pigment) | 6 |

The mixture was pulverized and classified to prepare a mother toner having a volume-average particle diameter of about 7.5 μm. 0.4 parts of a hydrophobic silica having a hexamethyldisilazane treated surface and an average primary particle diameter of 0.02 μm as an external additive were mixed with 100 parts of the mother toner by a Henschel mixer to prepare a cyan color toner.

Example 8

The procedure of preparation for the toner in Example 1 was repeated except for changing the ethylacetate to toluene and the heating temperature to 110° C. The mother toner had a volume-average particle diameter of about 7.5 μm.

Synthesis Example 10

Synthesis of a Low-molecular Weight Latex

In a 1,000 ml four-opening flask equipped with a stirrer, a cooling tube and a thermocouple, 407.86 g of styrene, 70.94 g of n-butylacrylate, 27.86 g of methacrylic acid, 17.46 g of tert-dodecylmercaptan, 42.69 g of the crystalline polyester resin No. 4 and 10.37 g of ester pentaerythritoltetrabehenate were stirred until dissolved at an inner temperature of 85° C. to prepare a monomer liquid solution. On the other hand, an aqueous solution of a surfactant in which 0.8 g of sodium dodecylbenzenesulfonate were dissolved in 2,100 ml of purified water was similarly heated at an inner 85° C. and the temperature was maintained. The monomer liquid solution including the crystalline polyester resin No. 4 was included in the aqueous solution of a surfactant having an inner temperature of 85° C. while stirred, and the mixture was emulsified by an ultrasonic emulsifier to prepare an emulsion. Next, the emulsion was put in a 5,000 ml four-opening flask equipped with a stirrer, a cooling tube, a nitrogen inlet tube and a temperature sensor, and an aqueous solution of a polymerization starter in which 6.02 g of persulfate ammonium were dissolved in 400 ml of purified water was added to the emulsion while stirred at 70° C. under a nitrogen stream. Then, the mixture was polymerized for 4 hrs, cooled to have a room temperature and filtered to prepare a latex No. 1. The latex did not have a polymerization residue and quality thereof was stable. When a number-average primary particle diameter of the latex was measured by a cataphoresis light scattering photometer ELS-800 from Otsuka Electronics Co., Ltd., the number-average primary particle diameter there of was 120 nm. The latex had a glass transition temperature of 62° C. by a DSC and a solid content concentration of 20% by mass determined from the dry weight.

Synthesis Example 11

Synthesis of a Polymer Latex

In a 500 ml four-opening flask equipped with a stirrer, a cooling tube and a thermocouple, 73.98 g of styrene, 24.32 g of n-butylacrylate, 3.04 g of methacrylic acid, 0.096 g of tert-dodecylmercaptan, 10.67 g of the crystalline polyester resin No. 4 and 2.13 g of ester pentaerythritoltetrabehenate were stirred until dissolved at an inner temperature of 85° C. to prepare a monomer liquid solution. On the other hand, an aqueous solution of a surfactant in which 0.22 g of sodium dodecylbenzenesulfonate were dissolved in 430 ml of purified water was similarly heated at an inner 85° C. and the temperature was maintained. The monomer liquid solution including the crystalline polyester resin No. 4 was included in the aqueous solution of a surfactant having an inner temperature of 85° C. while stirred, and the mixture was emulsified by an ultrasonic emulsifier to prepare an emulsion. Next, the emulsion was put in a 5,000 ml four-opening flask equipped with a stirrer, a cooling tube, a nitrogen inlet tube and a temperature sensor, and an aqueous solution of a polymerization starter in which 0.22 g of persulfate ammonium were dissolved in 80 ml of purified water was added to the emulsion while stirred at 70° C. under a nitrogen stream. Then, the mixture was polymerized for 4 hrs, cooled to have a room temperature and filtered to prepare a latex No. 2. The latex did not have a polymerization residue and quality thereof was stable. When a number-average primary particle diameter of the latex was measured by a cataphoresis light scattering photometer ELS-800 from Otsuka Electronics Co., Ltd., the number-average primary particle diameter there of was 123 nm. The latex had a glass transition temperature of 64° C. by a DSC and a solid content concentration of 20% by mass determined from the dry weight.

Example 9

Toner Production by a Polymerization Method

In a 5,000 ml four-opening flask equipped with a stirrer, a cooling tube and a thermocouple, 1,000 g of the latex No. 1, 250 g of the latex No. 2, 900 ml of purified water and a carbon black dispersion liquid including 20 g of a dispersed carbon black Regal 330R from Cabot Corp. in an aqueous solution of a surfactant including 9.20 g of dissolved dodecylsodiumsulfate in 160 ml of purified water were mixed, and 5N of sodium hydrate was added to the mixture to have 10 pH. Further, an aqueous solution including 28.5 g of dissolved magnesium chloride hexahydrate in 1,000 ml of purified water was added to the mixture while stirred at a room, and the mixture was heated to have an inner temperature of 90° C. The dispersed particle diameter was measured by Coulter counter II from Coulter Electronics, Inc., and when the dispersed particle diameter was 6.5 μm, an aqueous solution including 80.6 g of dissolved sodium chloride in 700 ml of purified water was added to the mixture. Then, the mixture was reacted for 6 hrs at an inner temperature of 90° C. and cooled to have a room temperature. The thus prepared toner particles were filtered, resuspension to purified water and filtration thereof were repeated to wash the particles, and dried to prepare a black toner. The mother toner had a volume-average particle diameter of about 6.8 μm.

Synthesis Example 12

Synthesis of a Prepolymer Including an Isocyanate Group

In a reaction container with a cooling tube, a stirrer and a nitrogen inlet tube, 724 parts of an adduct of bisphenol A with 2 moles of ethyleneoxide, 276 parts of isophthalic acid and 2 parts of dibutyltinoxide were mixed. The mixture was reacted for 8 hrs at 230° C. under a normal pressure. Then the reaction was further performed for 5 hrs under a reduced pressure of from 10 to 15 mmHg. After the reaction product was cooled to 160° C., 32 parts of phthalic anhydride were added thereto to further perform a reaction for 2 hrs. Then, the reaction production was cooled to 80° C. and mixed with 188 parts of isophorondiisocyanate in ethyl acetate and reacted for 2 hrs to prepare a prepolymer including an isocyanate group No. 1 having a weight-average molecular weight of 12,000.

Synthesis Example 13

Synthesis of a Ketimine Compound

In a reaction container with a stirring stick and a thermometer, 30 parts of isophoronediamine and 70 parts of methyl ethyl ketone are mixed and reacted at 50° C. for 5 hrs to prepare a ketimine compound No. 1.

Synthesis Example 14

Synthesis of a Polyester Resin

In a reaction container with a cooling tube, a stirrer and a nitrogen inlet tube, 724 parts of an adduct of bisphenol A with 2 moles of ethyleneoxide and 276 parts of terephthalic acid were polycondensated for 8 hrs at 230° C. under a normal pressure. Then the reaction was further performed for 5 hrs under a reduced pressure of from 10 to 15 mmHg to prepare a polyester resin No. 1 having a weight-average molecular weight of 2,400, a hydroxyl value of 55, an acid value of 1 and Tg of 61° C.

Example 10

Toner Production by a Polyaddition Reaction Using a Prepolymer Including an Isocyanate Group In a beaker, 15.4 parts of the prepolymer including an isocyanate group No. 1, 64 parts of the polyester resin No. 1, 20 parts of the crystalline polyester resin No. 1 and 150 parts of ethylacetate were stirred and dissolved. Next, 20 parts of pentaerythritoltetrabehenate and 4 parts of Cyanine Blue KRO from SANYO COLOR WORKS, Ltd. were uniformly stirred, dissolved and dispersed in the mixture by a TK-type homomixer at 12,000 rpm and 60° C. Finally, 2.7 parts of the ketimine compound No. 1 were dissolved in the mixture to prepare a toner material liquid solution (1). In a beaker, 706 parts of ion exchanged water, 294 parts of 10% slurry of hydroxyapatite Supertite 10 from Nippon Chemical Industrial Co., Ltd. and 0.2 parts of sodium dodecylbenzenesulfonate were uniformly dissolved. Next, the toner material liquid solution (1) was included in the mixture and stirred by a TK-type homomixer at 12,000 rpm and 60° C. for 10 min. Then, the mixture was heated to have a temperature of 98° C. and urea-modified, and a solvent was removed therefrom in a flask with a stirrer and a thermometer. The thus prepared toner dispersion liquid was filtered, washed, dried and classified by a wind force to prepare a toner. The mother toner particle had a volume-average particle diameter of about 6 μm.

Examples 11 and 12

The procedures of preparation for the crystalline polyester resin No. 1 in Synthesis Example 1 were repeated to prepare crystalline polyester resins Nos. 7 and 8 except for changing the reaction time. The procedures of preparation for the toner in Example 1 were repeated to prepare toner in Examples 11 and 12 except for changing the crystalline polyester resin No. 1 to the crystalline polyester resins Nos. 7 and 8 respectively.

The toner and mother toner properties in Examples and Comparative Examples are shown in Tables 1-1, 1-2, 1-3 and 1-4.

TABLE 1-1

| | | Mother toner Thermoplastic resin | | |
|---|---|---|---|---|
| Example | Color | Name | Tg (° C.) | Molecular weight (Mw) |
| Example 1 | Cyan | Polyester | 59 | 17,000 |
| Example 2 | Black | Polyester | 32 | 11,000 |
| Example 3 | Magenta | Polystyrene acrylate | 78 | 85,000 |
| | | Polyol | 75 | 15,000 |
| Example 4 | Yellow | Polystyrene | 78 | 35,000 |
| Example 5 | Cyan | Polyester | 59 | 17,000 |
| Example 6 | Cyan | Polyester | 43 | 17,000 |
| Example 7 | Cyan | Polyester | 59 | 17,000 |
| Example 8 | Cyan | Polyester | 59 | 17,000 |
| Example 9 | Black | Copolymer | 63 | 7,000 |
| Example 10 | Cyan | Polyester | 59 | 17,000 |
| Example 11 | Cyan | Polyester | 59 | 17,000 |
| Example 12 | Cyan | Polyester | 59 | 17,000 |
| Comparative Example 1 | Cyan | Polyester | 59 | 17,000 |
| Comparative Example 2 | Cyan | Polyester | 26 | 9,200 |
| Comparative Example 3 | Cyan | Polyester | 59 | 17,000 |
| Comparative Example 4 | Cyan | Polyester | 59 | 17,000 |

TABLE 1-2

| | Mother toner Crystalline polymer | | | | |
|---|---|---|---|---|---|
| Example | Name | DSC endothermic peak temperature (° C.) | Molecular weight | Acid value mg KOH/g | Hydroxyl value mg KOH/g |
| Example 1 | Polyester | 119 | Mn 710<br>Mw 2,100 | 24 | 28 |
| Example 2 | Polyester | 96 | Mn 620<br>Mw 1,750 | 37 | 8 |
| Example 3 | Polyester | 128 | Mn 1,650<br>Mw 6,400 | 24 | 44 |
| | Polybutadiene | 124 | Mn 1,100<br>Mw 4,700 | | |
| Example 4 | Polyester | 82 | Mn 1,100<br>Mw 4,700 | 25 | 33 |
| Example 5 | Polyester | 113 | Mn 780<br>Mw 2,400 | 22 | 28 |
| Example 6 | Polyester | 128 | Mn 850<br>Mw 3,450 | 28 | 2 |
| Example 7 | Polyester | 119 | Mn 710<br>Mw 2,100 | 24 | 28 |
| Example 8 | Polyester | 119 | Mn 710<br>Mw 2,100 | 24 | 28 |
| Example 9 | Polyester | 82 | Mn 1,100<br>Mw 4,700 | 25 | 33 |
| Example 10 | Polyester | 119 | Mn 710<br>Mw 2,100 | 24 | 28 |
| Example 11 | Polyester | 123 | Mn 5,600<br>Mw 28,500 | 24 | 26 |
| Example 12 | Polyester | 121 | Mn 2,100<br>Mw 15,800 | 25 | 27 |
| Comparative Example 1 | None | — | — | — | — |
| Comparative Example 2 | Polyester | 119 | Mn 710<br>Mw 2,100 | 24 | 28 |
| Comparative Example 3 | Polypropylene | 136 | Mn 760<br>Mw 2,300 | | |
| Comparative Example 4 | Polyester | 119 | Mn 710<br>Mw 2,100 | 24 | 28 |

TABLE 1-3

| | Mother toner Wax | |
|---|---|---|
| Example | Name | DSC endothermic peak temperature (° C.) |
| Example 1 | Synthetic ester | 84.5 |
| Example 2 | Carnauba | 84 |
| Example 3 | Polyethylene | 123 |
| Example 4 | Synthetic ester | 72 |
| Example 5 | Synthetic ester | 74 |
| Example 6 | Synthetic ester | 84.5 |
| Example 7 | Synthetic ester | 84.5 |
| Example 8 | Synthetic ester | 84.5 |
| Example 9 | Synthetic ester | 84.5 |
| Example 10 | Synthetic ester | 84.5 |
| Example 11 | Synthetic ester | 84.5 |
| Example 12 | Synthetic ester | 84.5 |
| Comparative Example 1 | Synthetic ester | 84.5 |
| Comparative Example 2 | Synthetic ester | 84.5 |
| Comparative Example 3 | Synthetic ester | 84.5 |
| Comparative Example 4 | Polypropylene | 130 |

TABLE 1-4

| | Toner | | |
|---|---|---|---|
| Example | Crystalline polymer DSC endothermic peak temperature (° C.) | Wax DSC endothermic peak temperature (° C.) | Volume-average particle diameter d50 |
| Example 1 | 116 | 85 | 7.6 |
| Example 2 | 86 | 77 | 7.5 |
| Example 3 | 125<br>120 | 121 | 7.2 |
| Example 4 | 76 | 70 | 7.8 |
| Example 5 | 96 | 71 | 7.9 |
| Example 6 | 124 | 87 | 7.4 |
| Example 7 | 115 | 80 | 7.5 |
| Example 8 | 113 | 80 | 7.5 |
| Example 9 | 75 | 80 | 6.8 |
| Example 10 | 109 | 77 | 6 |
| Example 11 | 118 | 83 | 7.5 |
| Example 12 | 116 | 83 | 7.6 |
| Comparative Example 1 | None | 84 | 7.1 |
| Comparative Example 2 | 126 | 84 | 9 |
| Comparative Example 3 | 135 | 86 | 7.7 |
| Comparative Example 4 | 118 | 129 | 8.5 |

The respective toners in Examples 1 to 10 and Comparative Examples 1 to 4 were evaluated. The results are shown in Table 2.

TABLE 2

| Example | Pulverizability | High temperature preservability | Offset resistance | Low-temperature fixability | dispersibility |
|---|---|---|---|---|---|
| Example 1 | ◎ | ◎ | ◎ | ○ | ○ |
| Example 2 | ◎ | ○ | ○ | ◎ | ◎ |
| Example 3 | ◎ | ◎ | ◎ | ○ | ○ |
| Example 4 | ○ | ○ | ○ | ◎ | ◎ |
| Example 5 | ◎ | ○ | ○ | ◎ | ◎ |
| Example 6 | | ◎ | ◎ | ○ | ○ |
| Example 7 | ◎ | ◎ | ◎ | ○ | ○ |
| Example 8 | ◎ | ◎ | ◎ | ○ | ○ |
| Example 9 | ◎ | ○ | ○ | ◎ | ◎ |
| Example 10 | ◎ | ○ | ○ | ◎ | ◎ |
| Example 11 | ◎ | ◎ | ◎ | ○ | ○ |
| Example 12 | ◎ | ◎ | ◎ | ○ | ○ |
| Comparative Example 1 | Δ | Δ | X | Δ | Δ |
| Comparative Example 2 | X | X | X | X | ◎ |
| Comparative Example 3 | Δ | ◎ | Δ | X | X |
| Comparative Example 4 | Δ | ◎ | Δ | X | Δ |

This document claims priority and contains subject matter related to Japanese Patent Application No. 2002-331217 filed on Nov. 14, 2002, incorporated herein by reference in its entirety.

Having now fully described the invention, it will be apparent to one of ordinary skill in the art that many changes and modifications can be made thereto without departing from the spirit and scope of the invention as set forth therein. Where a numerical limit or range is stated, all values and subranges therewithin are specifically included as if explicitly written out.

The invention claimed is:

1. A toner comprising:

a thermoplastic resin;

a colorant;

a wax; and a crystalline polymer, wherein at least one of the following formulas (I) or (II) is satisfied:

$$Tg(W_T)<Tg(W_W)-2°\ C. \quad (I)$$

$$Tg(CP_T)<Tg(CP_{CP})-2°\ C. \quad (II),$$

wherein $Tg(W_T)$ and $Tg(W_W)$ are the DSC endothermic peak temperatures in ° C. of the wax measured in the toner and the wax measured alone, respectively and $Tg(CP_T)$ and $Tg(CP_{CP})$ are the DSC endothermic peak temperatures in ° C. of the crystalline polymer measured in the toner and the crystalline polymer measured alone, respectively, wherein a heating rate of the DSC measurement is 10° C./min;

wherein a CuK α X-ray diffraction spectrum of the crystalline polymer comprises a plurality of diffraction peaks, and wherein the diffraction peaks are observed at Bragg (2θ) angles of at least 19 to 20°, 21 to 22°, 23 to 25° and 29 to 31° wherein said angles may vary by ±0.2°.

2. The toner of claim 1, wherein each of the wax and the crystalline polymer has a maximum average particle diameter of not less than 0.5 μm in a major axis diameter and not greater than ⅓ of a maximum particle diameter of the toner.

3. The toner of claim 1, wherein the crystalline polymer is present in an amount of 1 to 50 parts by weight based on 100 parts by weight of the thermoplastic resin.

4. The toner of claim 1, wherein the crystalline polymer has a DSC endothermic peak temperature of from 80 to 150° C.

5. The toner of claim 1, wherein the components of the crystalline polymer soluble in ortho-dichlorobenzene have a weight-average molecular weight (Mw) of from 1,000 to 30,000 and a number-average molecular weight (Mn) of from 500 to 6,000 by gel permeation chromatography, and wherein a ratio Mw/Mn is from 2 to 8.

6. The toner of claim 1, wherein the components of the crystalline polymer soluble in ortho-dichlorobenzene have a weight-average molecular weight (Mw) of from 1,000 to 6,500 and a number-average molecular weight (Mn) of from 500 to 2,000 by gel permeation chromatography, and wherein a ratio Mw/Mn is from 2 to 5.

7. The toner of claim 1, wherein the crystalline polymer has an acid value of from 20 to 45 mg KOH/g.

8. The toner of claim 1, wherein the crystalline polymer has a hydroxyl value of from 5 to 50 mg KOH/g.

9. The toner of claim 1, wherein the crystalline polymer is a crystalline polyester resin having the following formula:

$$[—O—COCR_1CR_2—CO—O—(CH_2)_n—]_m$$

wherein $R_1$ and $R_2$ independently represent a hydrocarbon group, and n and m are integers.

10. The toner of claim 9, wherein the crystalline polyester resin comprises polymerized units of:

a diol compound having 2 to 6 carbon atoms; and at least one member selected from the group consisting of maleic acid, fumaric acid, succinic acid and compounds thereof.

11. The toner of claim 10, wherein the crystalline polymer comprises at least one polymerized diol compound selected from the group consisting of 1,4-butanediol, 1,6-hexanediol and compounds thereof.

12. The toner of claim 1, wherein the thermoplastic resin has a glass transition temperature of from 30 to 80° C.

13. The toner of claim 1, wherein the thermoplastic resin has a weight-average molecular weight of from 2,000 to 9,000.

14. The toner of claim 1, wherein the thermoplastic resin is at least one member selected from the group consisting of a polyester resin, a polyol resin, a polystyrene resin and a polystyrene-acrylic copolymer resin.

15. The toner of claim 1, wherein the wax has a melting point of from 70 to 125° C.

16. The toner of claim 1, wherein the wax is at least one member selected from the group consisting of carnauba wax, a polyethylene wax and a synthetic ester wax.

17. The toner of claim 1, further comprising at least one of an inorganic particulate material or a particulate resin.

18. A method of producing the toner according to claim 1, comprising:

dissolving or dispersing a toner composition comprising the thermoplastic resin, the colorant, the wax and the crystalline polymer in an organic solvent, heating to prepare a toner liquid solution or a toner dispersion liquid;

removing the organic solvent from the toner liquid solution or toner dispersion liquid to prepare a toner material; and pulverizing and optionally classifying the toner material.

19. The method according to claim 18, further comprising:

dispersing each of the wax and the crystalline polymer in a liquid before dissolving or dispersing the toner composition, wherein the wax and crystalline polymer have a maximum average particle diameter not less than 0.5 μm in a major axis diameter and not greater than ⅓ of a maximum particle diameter of the toner.

20. A method of producing the toner according to claim 1, comprising:

mixing and kneading a toner composition comprising the thermoplastic resin, the colorant, the wax and the crystalline polymer, heating with a kneader to prepare a toner material; and pulverizing and optionally classifying the toner material.

21. A method of producing the toner according to claim 1, comprising:

directly polymerizing a toner composition comprising a polymerizable monomer, the colorant, the wax and the crystalline polymer in an aqueous phase.

22. A method of producing the toner according to claim 1, comprising:

subjecting a toner composition comprising a prepolymer including an isocyanate group, the colorant, the wax and the crystalline polymer and one or more amines to a polyaddition reaction to at least elongate or crosslink the prepolymer.

23. The method according to claim 21, further comprising:

dispersing each of the wax and the crystalline polymer in a liquid before directly polymerizing the toner composition, wherein the wax and crystalline polymer have a maximum average particle diameter not less than 0.5 μm in a major axis diameter and not greater than ⅓ of a maximum particle diameter of the toner.

24. The method according to claim 22, further comprising:

dispersing each of the wax and the crystalline polymer in a liquid before subjecting the toner composition to the polyaddition reaction, wherein the wax and crystalline polymer have a maximum average particle diameter not less than 0.5 μm in a major axis diameter and not greater than ⅓ of a maximum particle diameter of the toner.

25. A one-component developer comprising the toner according to claim 1.

26. A toner container comprising the one-component developer according to claim 25.

27. A two-component developer comprising a carrier and the toner according to claim 1.

28. A toner container comprising the two-component developer according to claim 27.

29. An image forming method comprising:

developing an electrostatic latent image formed on an image bearer with the one-component developer according to claim 25 to form a toner image thereon;

transferring the toner image onto an image support medium; and fixing the toner image on the image support medium with a fixer having at least a roller or a belt upon application of heat and pressure to the toner image.

30. An image forming method comprising:

developing an electrostatic latent image formed on an image bearer with the two-component developer according to claim 27 to form a toner image thereon;

transferring the toner image onto an image support medium; and fixing the toner image on the image support medium with a fixer having at least a roller or a belt upon application of heat and pressure to the toner image.

31. An image forming apparatus comprising:

an image developer configured to develop an electrostatic latent image formed on an image bearer with the one-component developer according to claim 25 to form a toner image thereon;

a transferer configured to transfer the toner image onto an image support medium; and a fixer configured to fix the toner image on the image support medium upon application of heat and pressure with at least a roller or a belt.

32. An image forming apparatus comprising:

an image developer configured to develop an electrostatic latent image formed on an image bearer with the two-component developer according to claim 27 to form a toner image thereon;

a transferer configured to transfer the toner image onto an image support medium; and a fixer configured to fix the toner image on the image support medium upon application of heat and pressure with at least a roller or a belt.

33. A process cartridge detachable from an image forming apparatus comprising:

a photoreceptor;

a member selected from the group consisting of a charger, and a cleaner; and an image developer comprising the developer according to claim 25.

34. A detachable process cartridge with an image forming apparatus comprising:

a photodetector;

the developer according to claim 25; and at least one member selected from the group consisting of a charger and an image developer.

35. A process cartridge detachable from an image forming apparatus comprising;

a photoreceptor; and at least one member selected from the group consisting of a charger, and a cleaner; and an image developer comprising the developer according to claim 27.

36. A detachable process cartridge with an image forming apparatus comprising;

a photoreceptor;

the developer according to claim 27; and at least one member selected from the group consisting of a charger and an image developer.

* * * * *